US005562047A

United States Patent [19]

Forney et al.

[11] Patent Number: 5,562,047

[45] Date of Patent: Oct. 8, 1996

[54] MODULAR SPILL DECK

[75] Inventors: Frank G. Forney, Tyrone; Matthew J. Huff, Altoona, both of Pa.; Mark Shaw, Ponte Vedra, Fla.; Robert J. Starr, Tyrone, Pa.

[73] Assignee: New Pig Corporation, Tipton, Pa.

[21] Appl. No.: 444,570

[22] Filed: May 19, 1995

[51] Int. Cl.[6] ..... B65D 19/00

[52] U.S. Cl. ..... 108/51.1; 206/386; 220/571; 220/23.4; 108/56.1; 108/24

[58] Field of Search ..... 108/51.1, 56.1, 108/24, 25, 64, 901; 248/346.02; 206/386; 220/571, 23.4

[56] References Cited

U.S. PATENT DOCUMENTS

| | | | |
|---|---|---|---|
| 3,857,342 | 12/1974 | Johns | 108/53 |
| 4,062,301 | 12/1977 | Pitchford | 108/56.1 |
| 4,095,769 | 6/1978 | Fengels | 248/346 |
| 4,694,962 | 9/1987 | Taub | 206/600 |
| 4,838,178 | 6/1989 | Chriske et al. | 108/55.1 |
| 4,930,632 | 6/1990 | Eckert et al. | 206/386 |
| 5,007,557 | 4/1991 | Spence | 220/571 |
| 5,020,667 | 6/1991 | Bush | 206/386 |
| 5,036,976 | 8/1991 | Sechler et al. | 206/386 |
| 5,092,251 | 3/1992 | Hamaker et al. | 108/51.1 |
| 5,147,039 | 9/1992 | Sechler et al. | 206/386 |
| 5,249,699 | 10/1993 | Williams | 220/571 |
| 5,254,798 | 10/1993 | Zoback | 588/259 |
| 5,307,931 | 5/1994 | Gillispie et al. | 206/386 |
| 5,359,955 | 11/1994 | Grebenyuk | 108/51.1 |
| 5,392,911 | 2/1995 | Gillispie et al. | 108/51.1 X |
| 5,429,236 | 7/1995 | Evans | 206/386 |

FOREIGN PATENT DOCUMENTS

| | | | |
|---|---|---|---|
| 303264 | 2/1989 | European Pat. Off. | 206/386 |
| 6199335 | 7/1994 | Japan | 220/23.4 |
| 1125001 | 8/1968 | United Kingdom | 220/23.4 |

*Primary Examiner*—Peter M. Cuomo
*Assistant Examiner*—Janet M. Wilkens
*Attorney, Agent, or Firm*—Buchanan Ingersoll, P.C.; Michael L. Dever

[57] ABSTRACT

A spill deck module includes a substantially planar bottom wall, a pair of opposing side walls and a pair of opposing end walls which form an interior chamber. Each side wall and end wall includes an aperture allowing fluid communication between adjacent modules. Initially, the side wall and end wall apertures are closed by a removable sealing assembly. When a number of modules are desired to be arranged to form a composite spill deck, the sealing assemblies in adjacent modules are removed and replaced with module connection assemblies allowing fluid transfer between adjacent modules. A deck grating either rests on the bottom surface of the spill deck or rests on top of ribs provided in each module. The grating forms a continuous spill deck for support of containers of hazardous or non-hazardous liquid materials in various configurations using different combinations of the spill decks.

7 Claims, 6 Drawing Sheets

MODULAR SPILL DECK

BACKGROUND OF THE INVENTION

1. Field of the Invention

This invention relates generally to a spill deck which can be used as a support for hazardous or non-hazardous material, machinery, or appliances, and, more particularly, to a spill deck constructed from a plurality of interlocking modules.

2. Description of the Prior Art

Various types of pallet structures are known in the art for supporting and transporting drums or other containers of hazardous and non-hazardous material. Many of these pallet devices include a basin or reservoir for containment of any material that leaks from the supported drums. For the most part, these known pallet structures have been comparatively complex in manufacture and assembly and have failed to efficiently provide for dispersal and containment of secondary hazardous or non-hazardous material spills from the supported drums.

One significant drawback to such prior art pallet structures is the height of the structure which generally is in the range of from 11 to 17 inches. This height is needed to so that the spill deck contains a sufficient capacity to comply with the requirements of 40 CFR § 264,175 for containment of hazardous material. Under this regulation, a spill deck must have sufficient volume to contain the greater of 100% of the volume of the largest container on the deck or 10% of the total volume of all containers while maintaining a separation of the vessel from the accumulated liquid. The height of the pallet structure prevents a container from being rolled thereon. Rather, mechanical lifting means must generally be used to place the container on the pallet.

U.S. Pat. No. 5,020,667 to Bush discloses a pallet structure including a confined chamber which is rectangular in shape and has a plurality of spaced rows of confined subchambers. The subchambers define rows of access passages extending therebetween to accommodate pallet lifting means, such as a fork lift. A tubular member can be used to support a grating and the tubular member includes a series of apertures which allow spilled materials to flow to their surrounding subchambers.

U.S. Pat. No. 5,092,151 to Hamaker et al. discloses a liquid containment pallet for containing liquid leaked or otherwise spilled from supportive industrial drums. A basin beneath the platform collects the spilled liquid through a series of openings. Thereafter, the liquid may be removed through a drain opening. The liquid containment portion for the pallet is vertically disposed with respect to the balance of the pallet. Additional hazardous material pallet structures are disclosed in U.S. Pat. Nos. 4,838,178; 4,930,632; 5,036,976; 5,147,039; 5,249,699; 5,254,798 and 5,307,931.

Material handling pallets, such as freight pallets and the like, that can be connected together to form a larger transport pallet are known in the art. These pallets are generally light weight, non-durable pallets designed for use with non-hazardous material containers. U.S. Pat. No. 4,095,769 to Fengels discloses an air freight pallet having connecting pieces which can be inserted on a connecting side of another pallet to join the pallets together. Other examples of connectable pallets are disclosed in U.S. Pat. Nos. 3,857,342; 4,062,301; and 4,694,962. None of these pallets are provided with a secondary containment volume sufficient to hold the leakage from a container.

It is an object of the present invention to provide a durable deck module for support of hazardous or non-hazardous material containers. It is a further object of the invention to provide a deck module which can be connected to other like-deck modules to form a deck assembly for support of hazardous or non-hazardous material containers while permitting fluid transfer from one deck to another.

SUMMARY OF THE INVENTION

A modular spill deck assembly for storing and supporting hazardous or non-hazardous material containers is provided in which a plurality of spill deck modules are interconnected to form a complete assembly. Each of the spill deck modules includes an interior chamber formed from a bottom wall, a pair of opposing side walls and a pair of opposing end walls. At least one wall of the pair of opposing side walls and pair of opposing end walls is provided with an aperture.

A connection assembly is provided between adjacent spill deck modules. This assembly passes through adjacent apertures in the end walls or side walls of these modules and allows fluid transfer or communication between adjacent spill deck modules. Preferably, the connection assembly includes a hollow connection member which passes through adjacent apertures and also through a gasket provided between adjacent spill deck modules. A sealing assembly is provided to seal those apertures which do not contain a connection assembly. Alternatively, if a module is designed such that at least one of its side or end walls will not be in contact with an adjacent module, the side or end walls of that module can be formed without any apertures.

In one preferred embodiment, a plurality of spaced-apart ribs are provided in the interior chamber of each spill deck. These ribs extend between the pair of opposing side walls. The ribs form a plurality of reservoirs within the interior chamber. Each of the plurality of ribs has at least one aperture provided therein which permits fluid transfer between adjacent reservoirs. These ribs support the grating, which, in turn, supports the containers or machinery placed on the spill deck.

In an alternative embodiment, the spill deck can be constructed without ribs in which case the grating rests on the bottom surface of the interior chamber. In this case, the grating itself includes apertures or other passageways permitting fluid transfer therethrough.

By permitting fluid transfer from one spill deck module to another, the modular assembly of the present invention can utilize the combined volume within all of the modules which are interconnected. Thus, the height of each spill deck module can be reduced without violating the regulations set forth in 40 CFR § 264,175.

DESCRIPTION OF THE PREFERRED EMBODIMENTS

Figure 1:
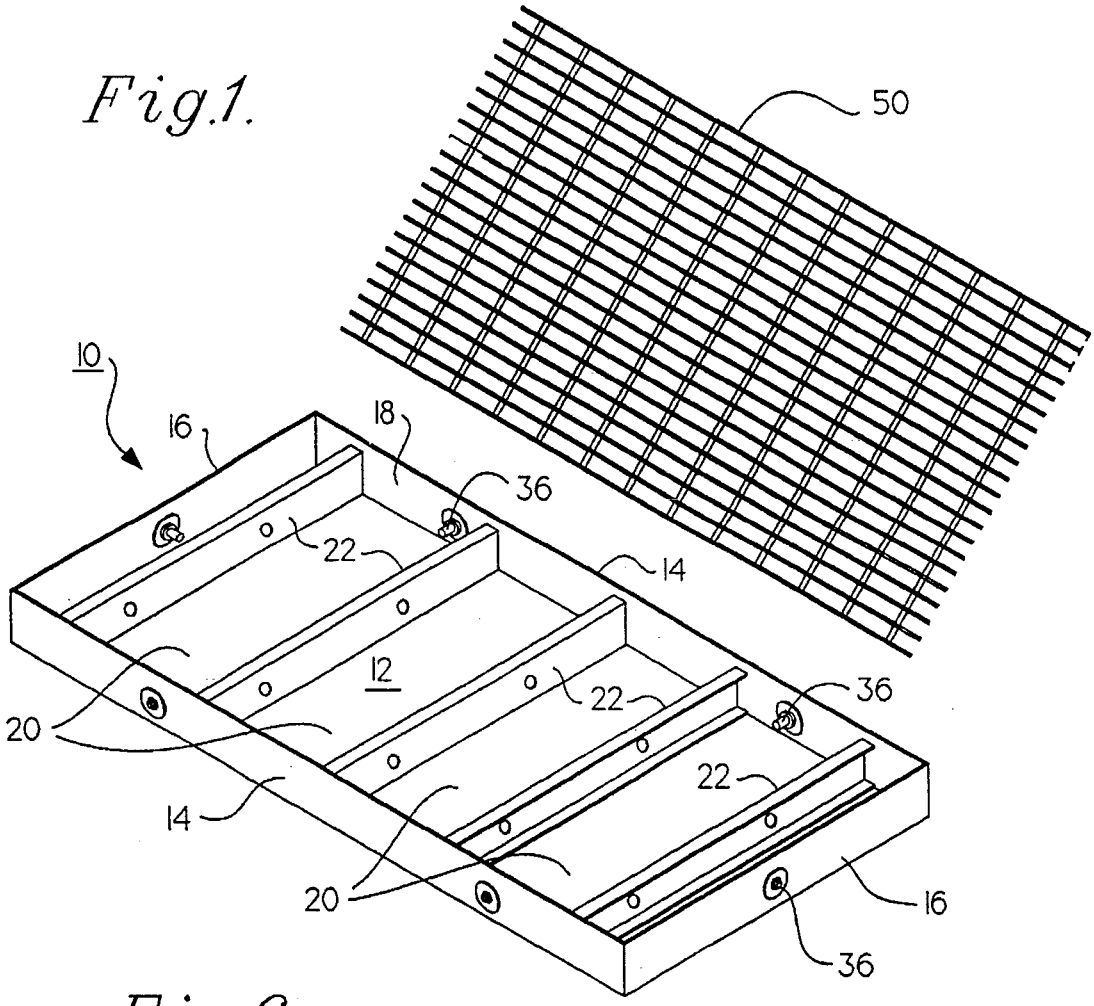
FIG. 1 is a perspective view of a first presently preferred embodiment of the spill deck module of the present invention.
Figure 6:
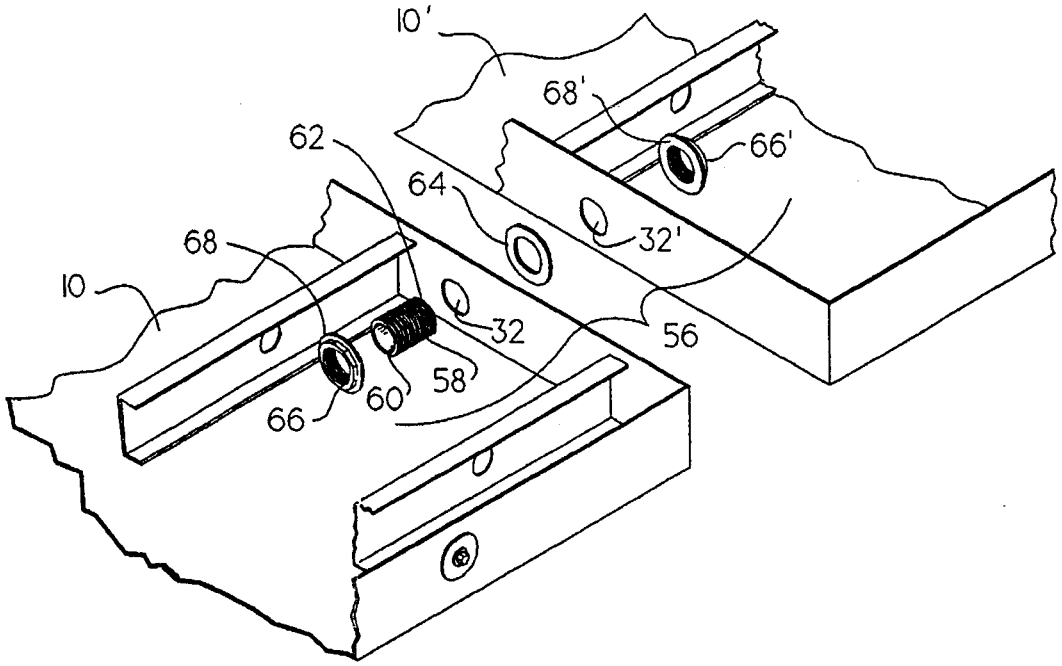
FIG. 6 is an expanded perspective view of a module connection assembly used to join modules together.

A spill deck module of the present invention is generally designated 10 in FIGS. 1–8 of the drawings. The spill deck module 10 has a substantially planar bottom wall 12, a pair of opposite side walls 14 and a pair of opposite end walls 16 which combine to form a chamber 18. Although chamber 18 is shown as being substantially rectangular, it can also be square or any other shape which permits the modules to be arranged to form a larger assembly. The bottom wall 12, side walls 14 and end walls 16 may be formed as an integral unit from a suitable corrosion-resistant material, such as steel or polyethylene, or may be individual components attached, for example, by welding or chemical bonding.

In the embodiment shown in FIG. 1, the interior chamber 18 of the spill deck module 10 is divided into a series of reservoirs 20 by a series of ribs 22 which run across the lateral width of spill deck module 10 between opposite side walls 14. Each rib 22 is preferably a C-shaped member having a substantially planar side portion 24, a planar top portion 26 and a base portion 28. Top portion 26 and base portion 28 are substantially parallel to each other. Each end of rib 22 is attached to one of side walls 14 and base portion 28 is attached to bottom wall 12. Side portion 24 of each rib 22 is shorter than side wall 14 of module 10 such that when ribs 22 are disposed in chamber 18 as described above, top portion 26 is located below the upper edge of side wall 14.

Each side portion 24 has a pair of rib apertures 30 provided therein. Each rib aperture 30 is preferably a 1-inch diameter circular hole whose center is positioned on a longitudinal axis of side portion 24. Alternatively, aperture 30 can be fashioned as a slot or in any other shape that permits fluid transfer between adjacent reservoirs 20. Each side wall 14 includes a pair of side wall module apertures 32. Each end wall 16 includes at least one end wall aperture 34.

Figure 2:
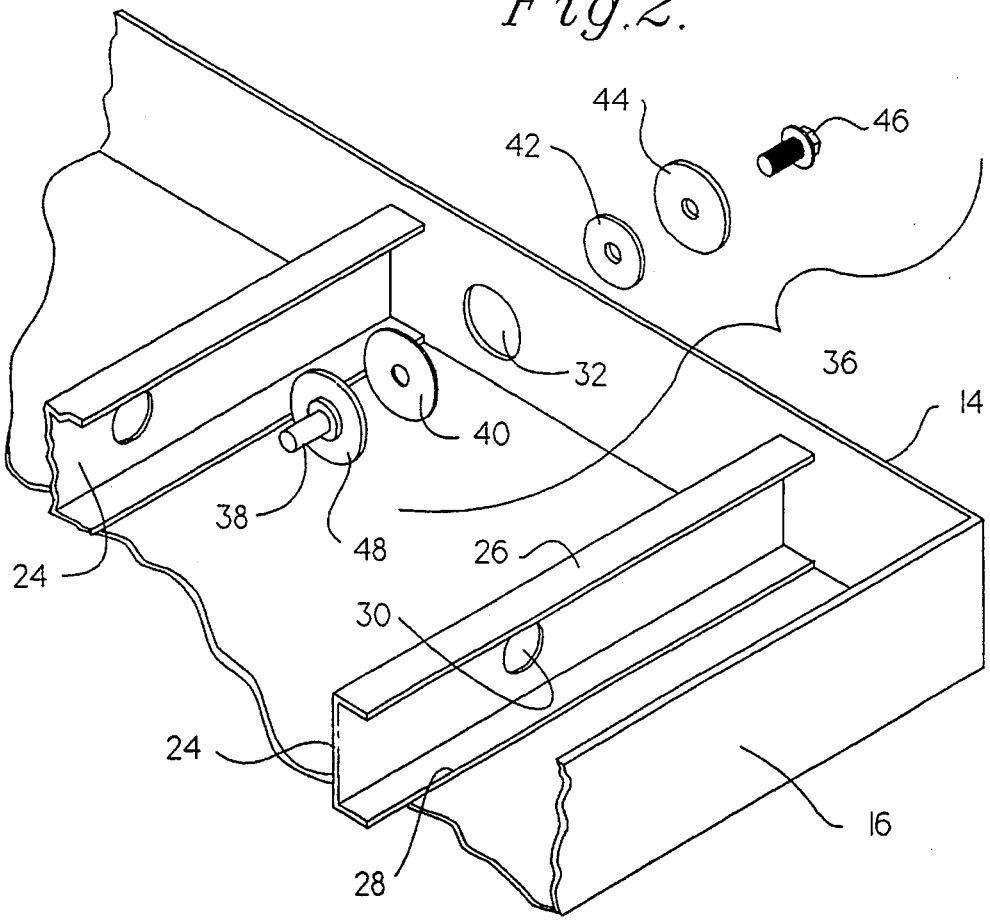
FIG. 2 is a perspective, expanded view of a plug assembly for use with the spill deck module.

Initially, each side wall aperture 32 and end wall aperture 34 is closed by a sealing assembly 36, shown in expanded view in FIG. 2. Sealing assembly 36 includes a threaded, female base member 38 and an inner sealing gasket 40 located inside interior chamber 18. Sealing assembly 36 further includes a centering washer 42, an outer washer 44 and a bolt 46. Centering washer 42 is sized so as to have a slightly smaller diameter as aperture 32 in order to allow centering washer 42 to fit within aperture 32.

In assembled condition, bolt 46 passes through outer washer 44 and centering washer 42 and into interior chamber 18 of module 10. Bolt 46 then passes through sealing gasket 40 and into base member 38. When bolt 46 is screwed into base member 38, the bolt head presses against outer washer 44 forcing sealing gasket 40 against the inside of side wall 14 and centering washer 42 is seated within aperture 32 of side wall 14 by flange 48 on base member 38. In this manner, each side wall aperture 32 is sealed. Each end wall aperture 34 is also sealed by a sealing assembly 36 in similar manner as described above with respect to the side wall apertures 32.

Figure 3:
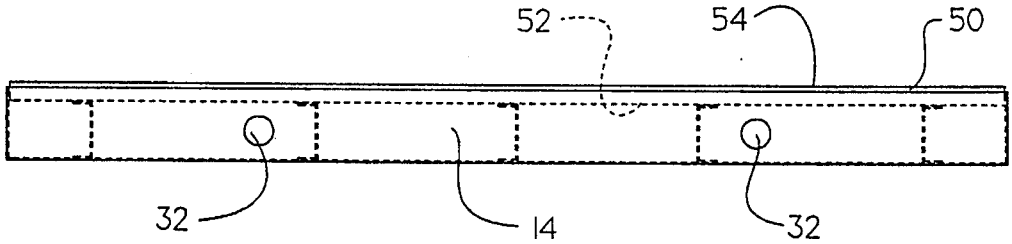
FIG. 3 is a side sectional view of the spill deck module.
Figure 4:
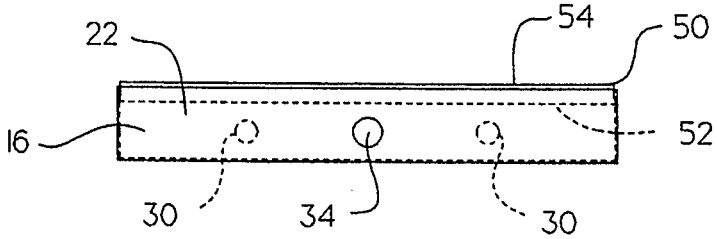
FIG. 4 is an end sectional view of the spill deck module.

As shown in FIGS. 1, 3 and 4, module 10 further includes grating 50. Grating 50, which can be formed from one or more grate sections, is placed in module 10 such that the bottom of grating 50 rests on top of top portion 26 of ribs 22. As shown in FIGS. 3 and 4, since top portion 26 is located below the tops of side walls 14 and end walls 16, a lower portion 52 of grating 50 abuts the interior surfaces of side walls 14 and end walls 16 thus preventing grating 50 from being displaced. Grating 50 is of sufficient height that an upper portion 54 of grating 50 extends above the tops of side walls 14 and end walls 16. Preferably, upper portion 54 should extend at least 0.25 inches above the tops of side walls 14 and end walls 16.

Figure 5:
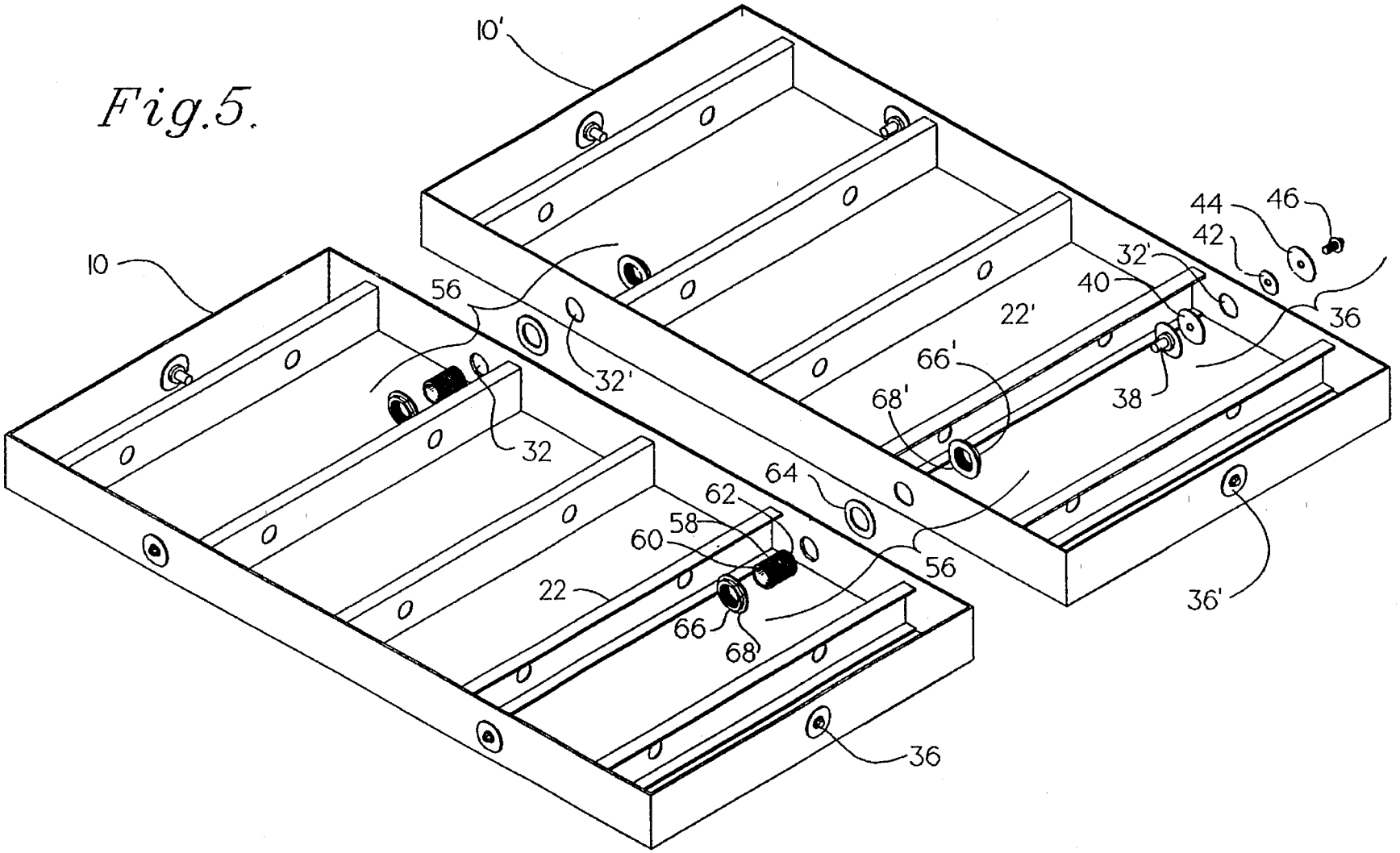
FIG. 5 is a side elevational view of two spill deck modules prior to connection of the modules.

The preferred method of connecting individual spill deck modules 10 together to form a larger spill deck assembly will now be discussed. FIG. 5 shows two spill deck modules 10 and 10' arranged side-by-side with their respective gratings 50 removed. To connect modules 10 and 10' together, sealing assemblies 36 located in adjacent side wall apertures 32 and 32' of module 10 and 10', respectively, are removed by unscrewing bolt 46 from base member 38. Adjacent modules 10 and 10' are then positioned such that adjacent side wall apertures 32 and 32' on module 10 and 10', respectively, are aligned with each other. The modules 10 and 10' are then pushed together and connected via a module connection assembly 56. Module connection assembly 56, shown in expanded form in FIG. 6, includes a hollow, cylindrical connection member 58 having a first end 60 and a second end 62. Connection assembly 56 further includes a hollow, circular gasket 64 and a pair of flange hexnuts 66 and 66'.

To connect adjacent modules 10 and 10' together, opposing side wall apertures 32 and 32' are aligned and a gasket 64 is positioned between opposing side wall apertures 32 and 32' on adjacent modules 10 and 10'. Second end 62 of connection member 56 is then passed through side wall aperture 32, through gasket 64, side wall aperture 32' and into the interior chamber of the adjacent module 10'. Flange hexnuts 66 and 66' are then screwed onto first end 60 and second end 62, respectively, of connection member 58. Flange hexnuts 66 and 66' are tightened onto connection member 58 until flange hexnut flanges 68 and 68' abut the interior of the respective side walls 14 of modules 10 and 10'.

A covering device (not shown), such as a C-channel, inverted V-channel or a U-channel, may be provided over adjacent side walls 14 and end walls 16 to prevent leakage of fluid between adjacent deck modules 10. Alternatively, the side wall 14 or end wall 16 of one of the deck modules 10 can be provided with an extended lip or flange which covers the space between adjacent spill deck modules 10 and 10'.

Figure 7:
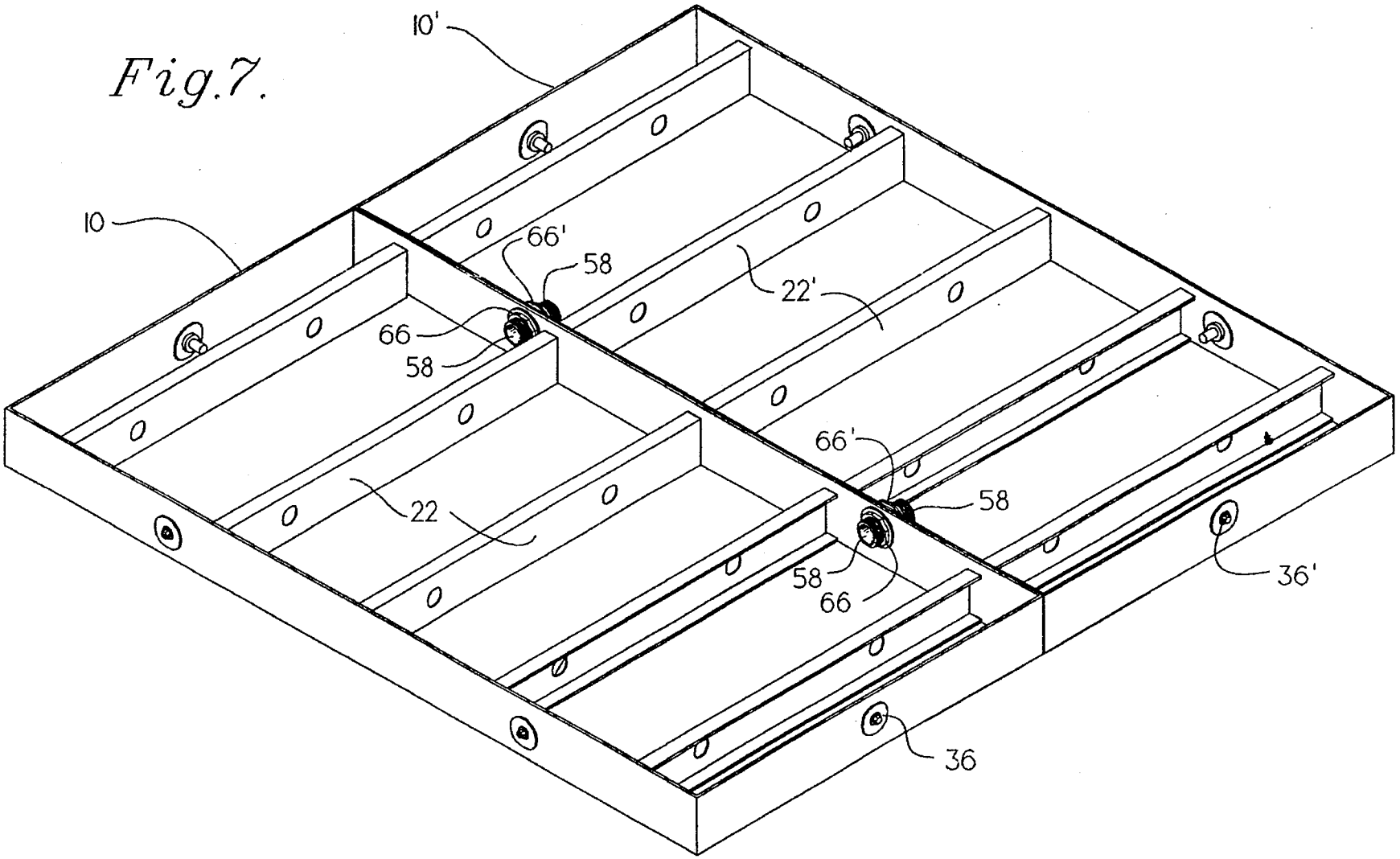
FIG. 7 is an elevational view of two modules joined by module connection assemblies into a module spill deck.
Figure 8:
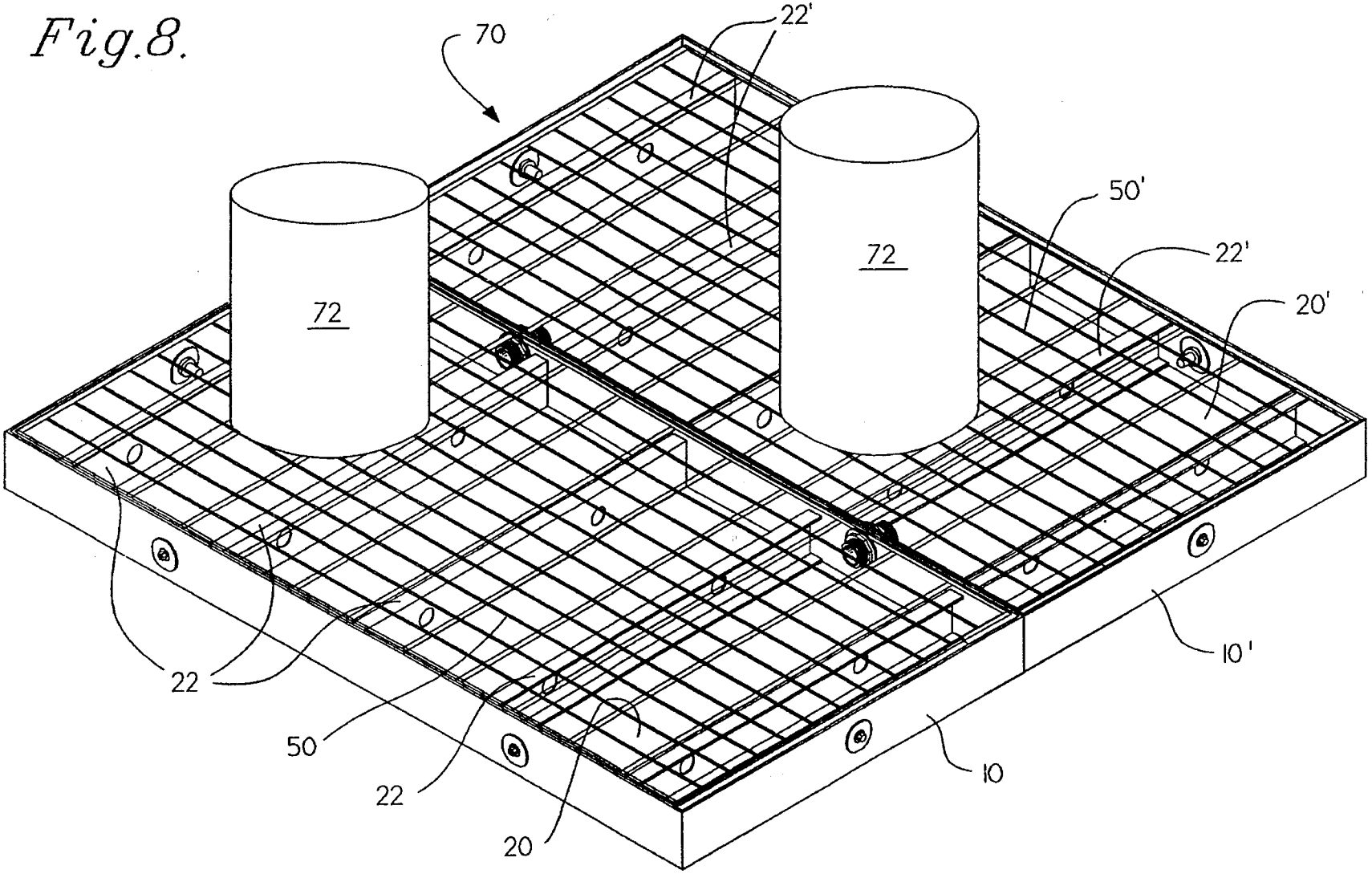
FIG. 8 is a side elevational view of waste containers resting on the modular spill deck of FIG. 7.

FIG. 7 shows two spill deck modules 10 and 10' connected through their respective side wall apertures 32 and 32' as described above. Alternatively, adjacent spill deck modules can be connected end-to-end via their end wall apertures 34 and 34' in a similar manner as described above with respect to connection of respective side wall apertures 32 and 32'. Gratings 50 and 50' for each of the individual spill deck modules 10 and 10' are then placed into respective spill deck modules 10 and 10' on top of ribs 22 and 22' to form a spill deck assembly 70 which consists of a plurality of interconnected spill deck modules 10, as shown in FIG. 8.

Hazardous or non-hazardous material containers 72, or the like, may then be positioned on top of grating 50. Should a leak occur in any of material containers 72, the hazardous or non-hazardous material flows through grating 50 into one of reservoirs 20 formed in interior chamber 18 of modules 10. If the leak should occur above a reservoir 20 into which connection member 58 protrudes, reservoir 20 will fill with hazardous material until the level reaches the lower lip of connection member 58 at which time it will flow through connection member 58 into adjacent reservoir 20' in adjacent spill deck module 10'.

Figure 9:
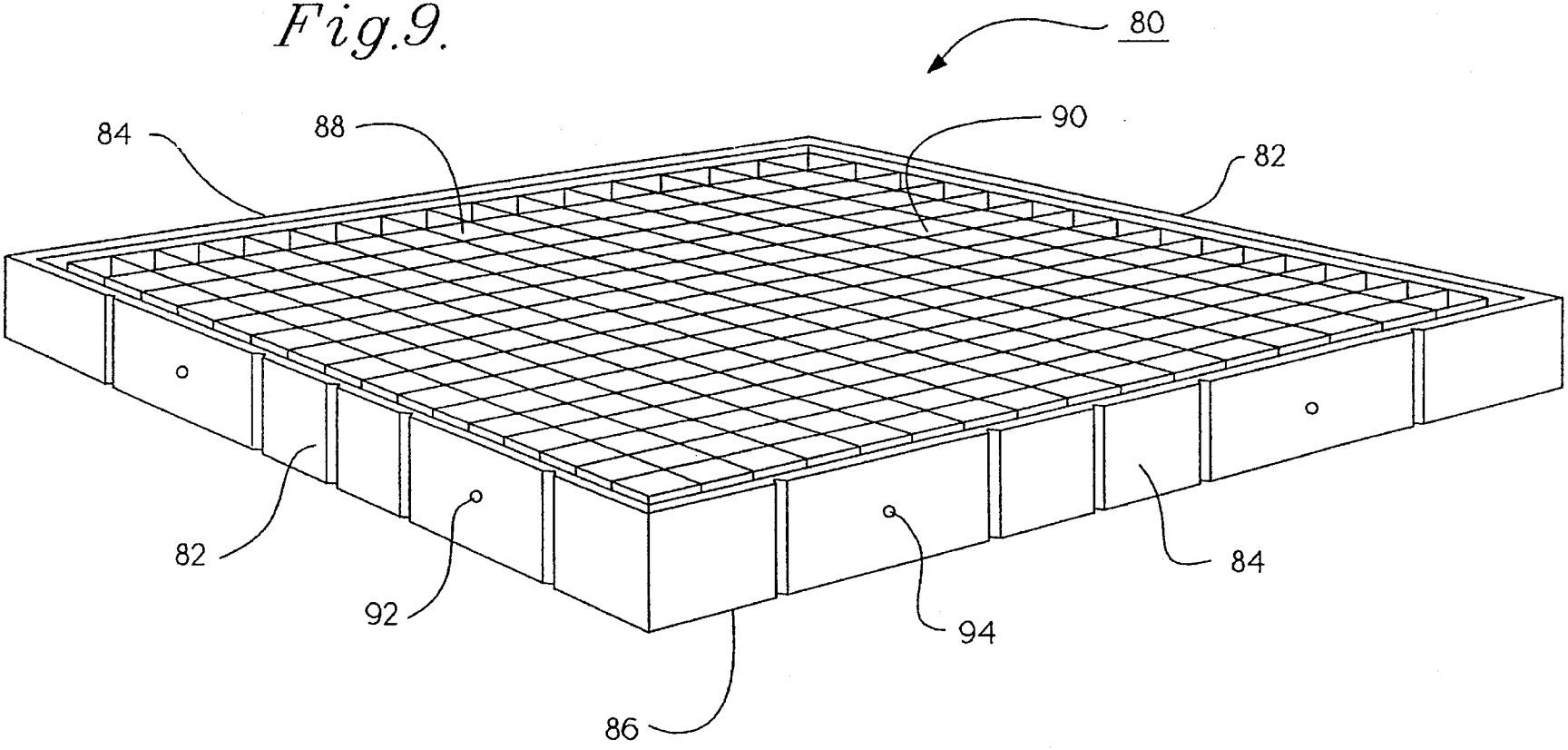
FIG. 9 is a perspective view of a second presently preferred embodiment of the spill deck module of the present invention.

FIG. 9 shows a second preferred embodiment of the spill deck assembly of the present invention which can be formed from either polyethylene or metal. In this embodiment, a module 80 is provided similar to module 10 of FIG. 1. Module 80 is formed from the combination of a pair of opposing side walls 82, a pair of opposing end walls 84 and a generally planar bottom surface 86 which form an interior chamber 88. Unlike the earlier embodiment, however, module 80 does include any ribs or other structure to support grating 90 above surface 86. Rather, grating 90 is designed to rest on bottom surface 86. Apertures or other openings in the grating 90 permit fluid transfer throughout interior chamber 88. Alternatively, grating 90 may be sized and positioned to permit fluid transfer around the ends or underneath the grating 90. If needed, additional apertures can be provided in grating 90 to make room for the bulkhead fittings.

Apertures 92 and 94 provided in the side walls 82 and end walls 84, respectively, of module 80 are similar to apertures 32 and 34 of module 10 shown in FIG. 1. The sealing assemblies and connection assemblies which can be used with module 80 can be similar to those used with module 10, but may be different if desired.

By using a combination of modules 10 and modules 90, a modular assembly can be formed. Because each of the separate modules 10 or 90 are interconnected, the volume of the modular assembly is the combined volume of each of the modules. Thus, the height of each module can be reduced. Accordingly, a lower-profile spill deck assembly can be constructed to take advantage of the added volume created by permitting fluid transfer between adjacent modules. Because of the reduced height of each module in the assembly, drums and containers can easily be rolled onto the top of each module without requiring the assistance of mechanical lifting means.

The modules can be arranged in various configurations using different combinations of spill decks to form a composite spill deck. The present invention is ideal for supporting a row of drums along a side wall of a machine shop or other industrial site wherein the entire length of the side wall can be used for the modular spill deck assembly.

The present assembly is suitable not only for supporting hazardous material containers but also for supporting non-hazardous material containers. Moreover, the present assembly can also be used to provide a sump for machinery which is prone to leak and can also serve as a sump for cleaning appliances and small items of machinery.

In the foregoing specification, reference was made to the modules 10 of the assembly 70 being placed adjacent one another. It is to be distinctly understood that the present invention applies as well to modules 10 which are spaced-apart, but nevertheless connected by piping or tubing to permit fluid transfer therebetween. In addition, such piping or tubing can be used to transfer fluid from a single spill deck module 10 or spill deck assembly 70 to a storage tank or collection sump. In this case, the fluid is transferred from the deck 10 or assembly 70 to the sump either by gravity or by pumping.

In the foregoing specification, certain preferred practices and embodiments of this invention have been set out. However, it will be understood that the invention may be otherwise embodied within the scope of the following claims.

We claim:

1. A spill deck assembly comprising;

a. a plurality of adjacent spill deck modules, each of said plurality of spill deck modules comprising an interior chamber formed from a bottom wall, a pair of opposing side walls and a pair of opposing end walls, at least one of said pair of opposing side walls and said pair of opposing end walls having an aperture provided therein, said spill deck modules arranged such that said aperture in each of said adjacent spill deck modules are adjacent; and b. a connection assembly provided between said adjacent apertures, said connection assembly permitting fluid transfer between adjacent spill deck modules through said connection assembly.

2. A spill deck assembly comprising;

a. a plurality of adjacent spill deck modules, each of said plurality of spill deck modules comprising an interior chamber formed from a bottom wall, a pair of opposing side walls and a pair of opposing end walls, at least one of said pair of opposing side walls and said pair of opposing end walls having an aperture provided therein, said spill deck modules arranged such that said aperture in each of said adjacent spill deck modules are adjacent; and b. a connection assembly provided between said adjacent apertures, said connection assembly permitting fluid transfer between adjacent spill deck modules, wherein said connection assembly comprises a connection member provided through said adjacent apertures, said connection member providing communication between the interior chambers of said adjacent spill deck modules.

3. The spill deck assembly of claim 2 wherein said connection assembly further comprises a gasket provided between said adjacent apertures, said connection member passing through said gasket.

4. The spill deck assembly of claim 3 further comprising a sealing assembly provided within each remaining aperture in said at least one of said pair of opposing side walls and said pair of opposing end walls.

5. The spill deck assembly of claim 4 wherein at least one of said adjacent spill deck modules further comprises grating resting on said bottom wall, said grating provided with apertures to permit fluid transfer throughout said interior chamber.

6. The spill deck assembly of claim 4 wherein at least one of said adjacent spill deck modules further comprises a plurality of spaced-apart ribs provided in said interior chamber, said ribs extending between said pair of opposing side walls, said plurality of ribs forming a plurality of reservoirs within said interior chamber, each of said plurality of ribs having at least an aperture provided therein permitting fluid transfer between adjacent reservoirs.

7. The spill deck assembly of claim 6 wherein each of said spill deck modules further comprises said grating resting on a top portion of said plurality of ribs, said grating having an upper portion which extends above a top portion of said pair of opposing side walls and said pair of opposing end walls.

* * * * *